US006505574B1

(12) United States Patent
Naud et al.

(10) Patent No.: US 6,505,574 B1
(45) Date of Patent: Jan. 14, 2003

(54) VERTICAL MOTION COMPENSATION FOR A CRANE'S LOAD

(75) Inventors: Steven F. Naud, Lynn Haven, FL (US); Max D. Weber, Panama City Beach, FL (US); Lei Lani Lucero, Hampton, VA (US); J. Dexter Bird, III, Hampton, VA (US); Martin D. Fink, Bethesda, MD (US); Christoph Hyder, Norfolk, VA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 09/947,079

(22) Filed: Sep. 5, 2001

(51) Int. Cl.[7] ..... B63B 27/00; B66C 23/53
(52) U.S. Cl. ..... 114/268; 212/308; 414/139.6
(58) Field of Search ..... 114/268; 212/308; 414/139.6, 139.7

(56) References Cited

U.S. PATENT DOCUMENTS

| | | | | |
|---|---|---|---|---|
| 4,147,330 A | * | 4/1979 | Eik | 414/139.6 |
| 4,238,037 A | * | 12/1980 | Azovtsev et al. | 114/125 |
| 4,327,784 A | * | 5/1982 | Denniston | 114/261 |
| 4,666,357 A | * | 5/1987 | Babbi | 414/138 |
| 4,932,541 A | * | 6/1990 | Belsterling | 212/308 |
| 6,082,947 A | * | 7/2000 | Adamson | 212/308 |

* cited by examiner

*Primary Examiner*—S. Joseph Morano
*Assistant Examiner*—Andy Wright
(74) *Attorney, Agent, or Firm*—Harvey A. Gilbert

(57) ABSTRACT

A method and system are provided for reducing sea state induced vertical motion of a shipboard crane's load. Sea state induced vertical velocity of the crane's suspended load is determined as a function of: i) the horizontal radial distance the load extends from the crane's axis of rotation, and ii) motion of the ship at the crane's axis of rotation. The load is then moved vertically at a speed that is defined as being equal to the vertical velocity in a direction that is opposite that of the vertical velocity.

8 Claims, 2 Drawing Sheets

VERTICAL MOTION COMPENSATION FOR A CRANE'S LOAD

ORIGIN OF THE INVENTION

The invention described herein was made in the performance of official duties by a employees of the Department of the Navy and may be manufactured, used, licensed by or for the Government for any governmental purpose without payment of any royalties thereon.

FIELD OF THE INVENTION

The invention relates generally to control systems for cranes, and more particularly to a method and system that compensates for vertical motion of a shipboard crane's load due to sea state conditions.

BACKGROUND OF THE INVENTION

Sea transportation of cargo is carried on throughout the world. In many applications, cargo transfer between ships, or from ships to piers, is supported by means of pedestal cranes mounted aboard a ship. Typically, these cranes hoist a load, pivot about a centerline of rotation, and then lower the load onto an awaiting deck or other platform. Such cargo transfer must be controlled by trained and experienced operators since the loads being manipulated are substantial. However, if cargo transfer is to be carried out in elevated sea states, i.e., in excess of sea state 1, even the experienced crane operator may not be able to cope with vertical motion imparted to the load as the ship rolls, pitches and heaves.

SUMMARY OF THE INVENTION

Accordingly, it is an object of the present invention to provide a-method and system for reducing sea state induced vertical motion of a shipboard crane's load.

Another object of the present invention is to provide a method and system for use in combination with a crane operator's control inputs to reduce sea state induced vertical motion of a shipboard crane's load.

Other objects and advantages of the present invention will become more obvious hereinafter in the specification and drawings.

In accordance with the present invention, a method of and system are provided for reducing sea state induced vertical motion of a shipboard crane's load. The crane is mounted on a ship and is pivotable about an axis of rotation. The crane is capable of suspending a load at a horizontal radial distance from the crane's axis of rotation. Sea state induced vertical velocity of the load is determined as a function of the horizontal radial distance and motion of the ship at the crane's axis of rotation. Provisions are then made to move the load vertically at a speed that is defined as being equal to the vertical velocity in a direction that is opposite that of the vertical velocity.

The sea state induced vertical velocity of the load can be determined from the equation $$y(d\phi/dt)-x(d\theta/dt)+(dz/dt)$$

where y is a first vector component of the radial distance along a horizontal longitudinal axis of the ship passing through the crane's axis of rotation, x is a second vector component of the radial distance along a horizontal athwartship axis of the ship passing through the crane's axis of rotation, $d\phi/dt$ is a pitch rate of the ship about the horizontal athwartship axis, $d\theta/dt$ is a roll rate of the ship about the crane's horizontal longitudinal axis, and dz/dt is a heave rate of the ship at the crane's axis of rotation.

BRIEF DESCRIPTION OF THE DRAWINGS

Other objects, features and advantages of the present invention will become apparent upon reference to the following description of the preferred embodiments and to the drawings, wherein corresponding reference characters indicate corresponding parts throughout the several views of the drawings and wherein.

DETAILED DESCRIPTION OF THE INVENTION

Figure 1:
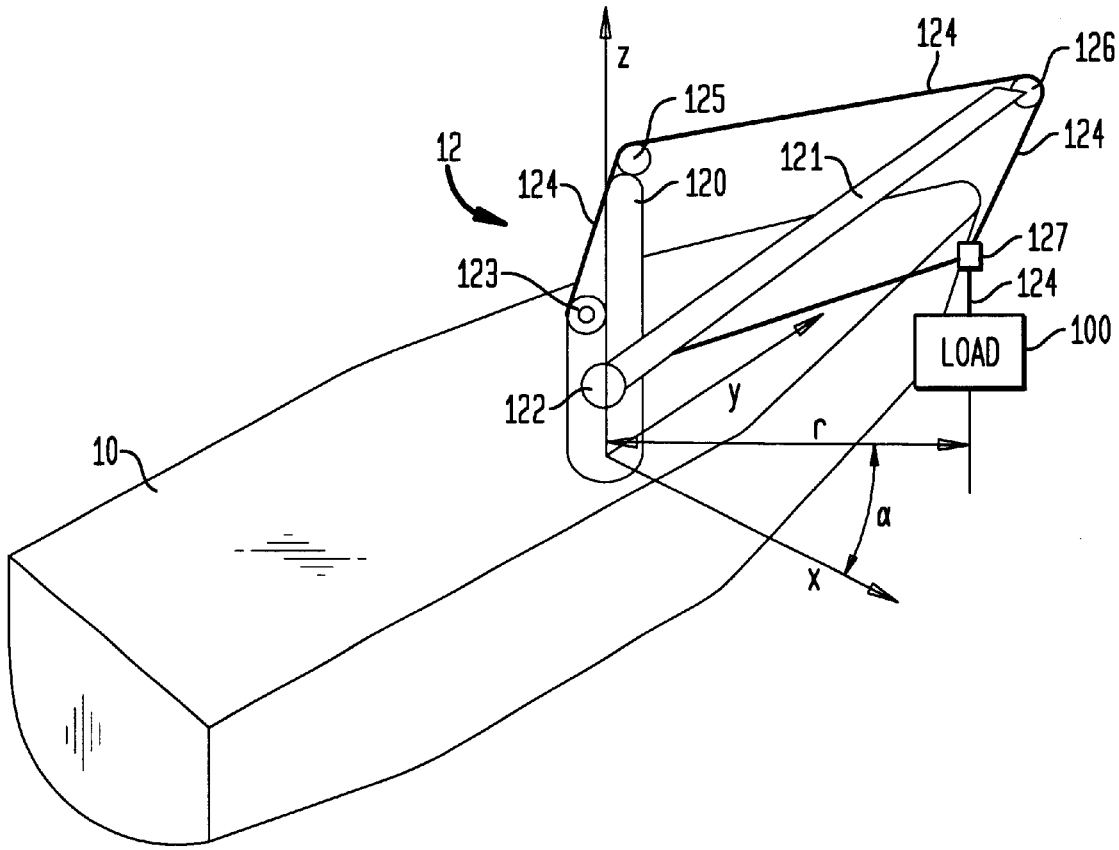
FIG. 1 is a perspective schematic view of a ship and a shipboard crane.

Referring now to the drawings, and more particularly to FIG. 1, a ship 10 having a pedestal crane 12 mounted thereon is illustrated. Crane 12 is pivotally mounted to ship 10 such that it can pivot about an axis of rotation which, in FIG. 1, is represented by the z-axis. Crane 12 includes a main support 120 and a boom 121 hingedly coupled thereto at hinge point 122. A hoisting system includes, for example, a hoist winch 123 for paying out or winding a cable 124 that is led over pulleys 125 and 126, passes through a rider bock 127, and terminates at a load 100. Load 100 is suspended only by cable 124. Such cranes are well known in the art.

An important geometric relationship utilized by the present invention is the radial distance r from the axis of rotation or z-axis to load 100 measured in the horizontal plane that is perpendicular to the z-axis. In FIG. 1, this horizontal plane is defined by the x and y axes where the x-axis is an athwartship axis passing through the axis of rotation or z-axis of crane 12. The y-axis is parallel with the ship's longitudinal axis and is perpendicular to the x and z axes. The positive x-axis will be considered to extend to the starboard of ship 10, the positive y-axis will be considered to extend to the bow of ship 10, and the positive z-axis is considered to extend upward. Thus, the (x,y) components of radial distance r are $$x=r\cos(\alpha)$$

$$y=r\sin(\alpha)$$

where $\alpha$ is the slew angle that boom 121 makes with the x-axis. By way of cenvention, slew angle a can be measured clockwise with respect to the positive x-axis.

In general, the present invention requires calculation of the vertical velocity of load 100 due to the motion of ship 10/crane 12 which is induced by sea state conditions. This vertical velocity is calculated from measurements of the configuration of crane 12 and the motion of ship 10. More specifically, crane configuration parameters include radial distance r and slew angle $\alpha$. Ship motion parameters include the pitch rate of ship 10 about the x-axis, the roll rate of ship 10 about the y-axis, and the heave rate of ship 10 at the axis of rotation of crane 12 or the z-axis in FIG. 1.

Once the vertical velocity of load 100 due to ship motion is determined, the present invention essentially commands crane 12 to move load. 100 vertically at a speed equal to the determined vertical velocity but in a (vertical) direction that is opposite that of the determined vertical velocity. In other words, the present invention nulls out the effects of the load's vertical velocity due to ship motion.

Figure 2:
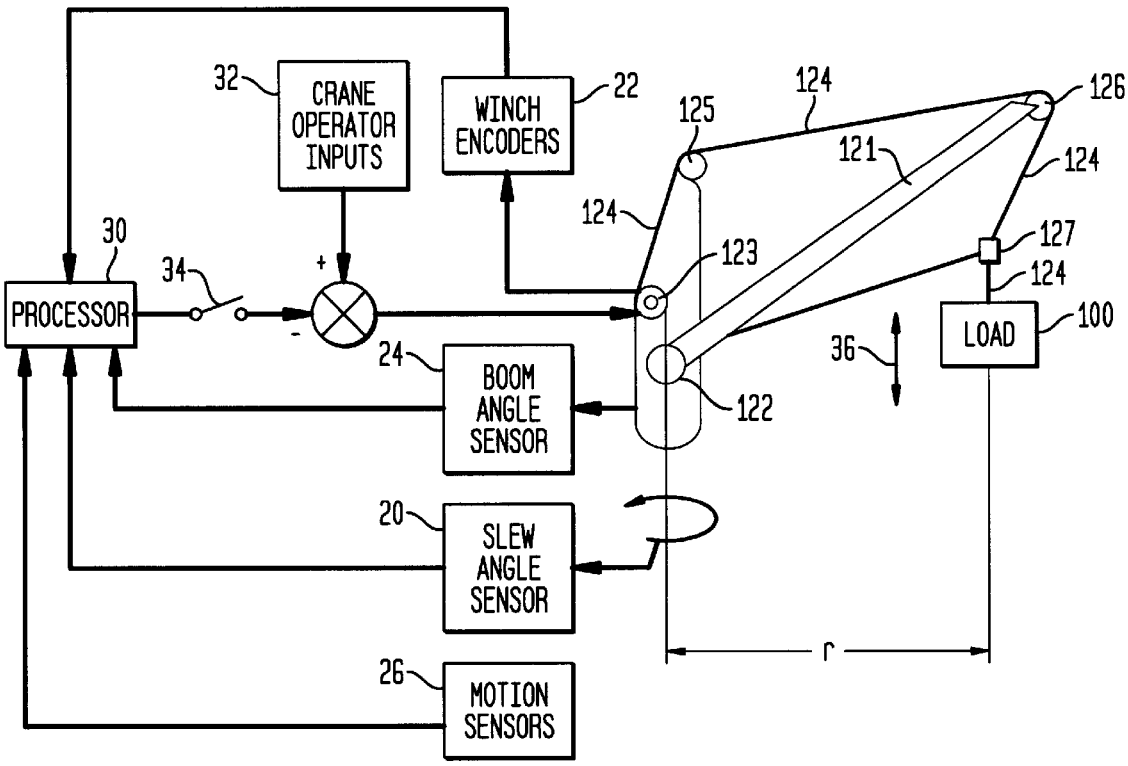
FIG. 2 is a functional block diagram of a system in accordance with the present invention for reducing sea state induced vertical motion experienced by a shipboard crane's suspended load.

A system for carrying out the method of the present invention is illustrated in FIG. 2 where like reference numerals are used for crane 12. A slew angle sensor 20 can be coupled to the crane's swing gear (not shown) located in the base of crane 12. Determination of radial distance r can be made by, for example, using winch encoders 22 and a boom angle sensor 24. More specifically, winch encoders 22 are coupled to the crane's winches (e.g., hoist winch 123) to provide a reading indicative of the amount of cable 124 paid out therefrom. The cable length(s) and boom angle are used to determine radial distance r in accordance with standard geometric principles as would be well understood in the art.

Ship motion sensors 26 provide the pitch, roll and heave rates of ship 10 at crane 12 described above. These rate measurements can be measured, for example, in the rotating base or turntable (not shown) of crane 12 and then correlated to the axis of rotation or z-axis of crane 12.

Sensors 20–126 provide their various measurements to a processor 30 that determines the vertical velocity of load 100 due to the motion of ship 10 brought on by sea state conditions. In the x,y,z coordinate system described above, the vertical velocity of load 100 can be written as $$v=y(d\phi/dt)-x(d\theta/dt)+(dz/dt)$$

where v represents the vertical velocity of load 100, dθ/dt is the pitch rate of ship 10 about the x-axis, dθ/dt is the roll rate of ship 10 about the y-axis, and dz/dt is the heave rate of ship 10 at the z-axis.

The speed value represented by vertical velocity v is subtracted from any crane operator inputs 32 to essentially null out the effects of sea state induced vertical motion (represented in FIG. 2 by two-headed arrow 36) on load 100. A switch 34 can be included to allow an operator to selectively include the present invention in the control of hoist winch 123. With switch 34 open vertical motion of load 100 is governed solely by crane operator inputs 32 and sea state induced vertical motion 36. However, when switch 34 is closed, processor's 30 calculated vertical motion is subtracted from crane operator inputs 32 to null the effects of sea state included vertical motion 36. That is, a control signal indicative of vertical speed of load 100 that is equal to and opposite of vertical motion 36 is combined with crane operator inputs 32.

In practical sense, it is impossible to completely null out the effects of sea state induced vertical motion 36. For this to occur, both the amplitude and phase of the response of the mechanism (e.g., hoist winch 123) implementing the speed control (output by processor 30) would have to match that of the control signal output by processor 30. Since no physical system can be built without some error in amplitude and/or phase, it is expected that some portion of induced vertical motion 36 will always be present. However, tests of the present invention have achieved approximately an 80% reduction in induced vertical motion 36.

The advantages of the present invention are numerous. Sea stated induced motion experienced by the suspended load of a shipboard crane can be substantially reduced by use of the present invention thereby allowing cargo transfer to take place safely. This will reduce the impact that weather currently has on cargo transfer operations.

Although the invention has been described relative to a specific embodiment thereof, there are numerous variations and modifications that will be readily apparent to those skilled in the art in light of the above teachings. For example, the various parameters in the calculation of vertical velocity v could be measured in manners other than described herein without departing from the scope of the present invention. It is therefore to be understood that, within the scope of the appended claims, the invention may be practiced other than as specifically described.

What is claimed as new and desired to be secured by Letters Patent of the United States is:

1. A method of reducing sea state induced vertical motion of a shipboard crane's load, comprising the steps of:

providing a crane mounted on a ship and pivotable about an axis of rotation, said crane suspending a load at a horizontal radial distance from said axis of rotation;

determining sea state induced vertical velocity of said load as a function of vector components of said horizontal radial distance and motion of said ship at said axis of rotation wherein said motion includes pitch, roll and heave rates of said ship at said axis of rotation; and moving said load vertically at a speed that is defined as being equal to said vertical velocity in a direction that is opposite that of said vertical velocity.

2. A method according to claim 1 wherein said crane has a hoist for adjusting said load vertically, and wherein said step of moving comprises the step of driving said hoist at said speed.

3. A method according to claim 1 wherein said step of moving includes the step of combining said speed with control inputs supplied to said crane by an operator thereof.

4. A method of reducing sea state induced vertical motion of a shipboard crane's load, comprising the steps of:

providing a crane mounted on a ship and pivotable about an axis of rotation, said crane suspending a load at a radial distance r from said axis of rotation;

determining sea state induced vertical velocity v of said load where $$v=y(d\phi/dt)-x(d\theta/dt)+(dz/dt)$$

where y is a first vector component of said radial distance r along a horizontal longitudinal axis of said ship passing through said axis of rotation, x is a second vector component of said radial distance r along a horizontal athwartship axis of said ship passing through said axis of rotation, dϕ/dt is a pitch rate of said ship about said horizontal athwartship axis, dθ/dt is a roll rate of said ship about said horizontal longitudinal axis, and dz/dt is a heave rate of said ship at said axis of rotation; and moving said load vertically at a speed that is defined as being equal to said vertical velocity in a direction that is opposite that of said vertical velocity.

5. A method according to claim 4 wherein said step of moving includes the step of combining said speed with control inputs supplied to said crane by an operator thereof.

6. A system for reducing sea state induced vertical motion of a load suspended a radial distance from an axis of rotation of a pivotable crane mounted on a ship, said system comprising:

means for determining sea state induced vertical velocity of said load as a function of vector components of said radial distance and motion of said ship at said axis of rotation wherein said motion includes pitch, roll and heave rates of said ship at said axis of rotation; and means for moving said load vertically at a speed that is defined as being equal to said vertical velocity in a direction that is opposite that of said vertical velocity.

7. A system as in claim 6 wherein said means for determining said vertical velocity comprises:

means for determining a first vector component of said radial distance along a horizontal longitudinal axis of said ship passing through said axis of rotation;

means for determining a second vector component of said radial distance along a horizontal athwartship axis of said ship passing through said axis of rotation;

means for determining said pitch rate of said ship about said horizontal athwartship axis;

means for determining said roll rate of said ship about said horizontal longitudinal axis;

means for determining said heave rate of said ship at said axis of rotation; and processing means for calculating said vertical velocity of said load as $$v=y(d\phi/dt)-x(d\theta/dt)+(dz/dt)$$

where v is said vertical velocity, y is said first vector component, x is said second vector component, $d\phi/dt$ is said pitch rate, $d\theta/dt$ is said roll rate and dz/dt is said heave rate.

8. A system as in claim 6 wherein said crane includes a hoist for raising and lowering said load predicated upon a hoist control input, and wherein said means for moving comprises means for adjusting said hoist control input to incorporate said speed.

* * * * *